US006904701B2

(12) United States Patent
Htoo et al.

(10) Patent No.: US 6,904,701 B2
(45) Date of Patent: Jun. 14, 2005

(54) FLASK AND METHOD FOR DRYING BIOLOGICAL MATERIALS

(75) Inventors: Thurein M. Htoo, Davis, CA (US); John H. Crowe, Davis, CA (US); Ann E. Oliver, Davis, CA (US); Fern Tablin, Davis, CA (US)

(73) Assignee: The Regents of The University of California, Oakland, CA (US)

( * ) Notice: Subject to any disclaimer, the term of this patent is extended or adjusted under 35 U.S.C. 154(b) by 19 days.

(21) Appl. No.: 10/077,413

(22) Filed: Feb. 15, 2002

(65) Prior Publication Data

US 2003/0154623 A1 Aug. 21, 2003

(51) Int. Cl.[7] ..... F26B 5/06; F26B 25/06

(52) U.S. Cl. ..... 34/284; 34/300; 34/296; 34/235

(58) Field of Search ..... 34/284, 285, 286, 34/287, 288, 298, 300, 296, 92, 235; 53/88, 89, 97, 109; 422/99; 215/308, 307; 210/318, 315, 203, 204, 295, 323.1, 335, 342, 406, 321.64

(56) References Cited

U.S. PATENT DOCUMENTS 2,564,174 A * 8/1951 Roman ..... 210/95
3,474,543 A * 10/1969 Bender et al. ..... 34/5
3,888,629 A * 6/1975 Bagshawe ..... 23/230 B
4,232,453 A * 11/1980 Edelmann ..... 34/92
4,275,511 A * 6/1981 Parkinson et al. ..... 34/92
4,286,389 A * 9/1981 Ogle ..... 34/5
4,306,357 A * 12/1981 Villarejos ..... 34/5
4,595,021 A * 6/1986 Shimizu et al. ..... 128/760
4,938,389 A * 7/1990 Rossi et al. ..... 222/189.08
4,966,469 A * 10/1990 Fraser et al. ..... 374/208
5,154,007 A * 10/1992 Piunni et al. ..... 34/5
5,522,155 A * 6/1996 Jones ..... 34/286
5,616,242 A * 4/1997 Mandola ..... 210/238
5,689,895 A * 11/1997 Sutherland et al. ..... 34/92
5,732,837 A * 3/1998 Jones ..... 215/311
5,811,060 A * 9/1998 Laguna Valderrama ..... 422/102
6,095,356 A * 8/2000 Rits ..... 215/261
6,122,836 A * 9/2000 Tenedini et al. ..... 34/92

* cited by examiner

*Primary Examiner*—Kenneth Rinehart
(74) *Attorney, Agent, or Firm*—Townsend and Townsend and Crew LLP

(57) ABSTRACT

A device for holding substances during drying comprising a flask having a structure defining an opening. A pair of contiguous or juxtaposed filters is disposed in the opening. A freeze-drying assembly comprising a freeze-drying apparatus, and the device disposed in the apparatus for holding substances during freeze-drying processing. A method for processing a substance under sterile conditions comprising disposing a substance in a flask, positioning the flask in a drying apparatus, and passing a drying medium through a pair of juxtaposed filters for drying the substance.

36 Claims, 7 Drawing Sheets

FIG. 10 Sample Freeze-drying

FLASK AND METHOD FOR DRYING BIOLOGICAL MATERIALS

STATEMENT REGARDING FEDERAL SPONSORED RESEARCH AND DEVELOPMENT

Embodiments of this invention were made with Government support under Grant No. 6600100C8048, awarded by the Department of Defense Advanced Research Projects Agency (DARPA). The Government has certain rights to embodiments of this invention.

BACKGROUND OF THE INVENTION

1. Field of the Invention

The present invention is related to a flask or container which is preferably used for drying biological materials. More specifically, embodiments of the present invention provide a flask for receiving biological materials, and method for treating or processing the biological materials while contained in the flask.

2. Description of the Prior Art

Dried biological materials are becoming increasingly useful in agriculture, biotechnology and medicine. For instance, freeze-dried human blood products, vaccines and the like are already in use, or are proposed to be in use, in clinical settings for both animal and human applications. In the field of biotechnology, biosensors have wide spread applications. In all such cases, long term storage under sterile conditions, and often under unfavorable environmental circumstances, is a requirement.

Conventional devices in the market do not optimally provide drying of biological materials under sterile conditions, while allowing for certain desired contamination-free processing of the biological materials under defined conditions, such as during drying, storage and re-hydration. More particularly, because biological materials show much improved survival if they are exposed to water vapor prior to immersion in liquid water, it is desired to pre-hydrate biological samples with water vapor without contaminating the biological samples.

A patentability investigation was conducted to determine the state of the art with respect to solving problems of contamination while processing biological materials during drying, storage and re-hydration, and the following U.S. Patents were discovered: U.S. Pat. No. 4,232,453 to Edelmann; U.S. Pat. No. 4,275,511 to Parkinsen, et al.; U.S. Pat. No. 4,966,469 to Fraser, et al.; U.S. Pat. No. 5,154,007 to Piunno, et al.; U.S. Pat. No. 5,689,595 to Sutherland, et al.; and U.S. Pat. No. 6,122,836 to Tenedini, et al.

U.S. Pat. No. 4,232,453 to Edelmann discloses a tray for holding a biological specimen and a submersible container for freeze-drying the specimen. A heating element is taught for melting a synthetic resin for embedding the specimen therein.

U.S. Pat. No. 4,275,511 to Parkinsen, et al. discloses an evaporator/sublimator flask having a straight sided cylinder, preferably made of borosilicate glass tubing of sufficient wall thickness to prevent implosion when subjected to a high vacuum. The straight sided cylinder is open at one end and sealed at the other. An elastomer cap is disposed over the open end of the cylinder.

U.S. Pat. No. 4,966,469 to Fraser, et al. discloses a flask for freeze-drying. A positioning device engages the top of the flask and comprises a generally circular stopper having an opening. An annular tube extends through the stopper and into the flask. A thermocouple is coiled around the lower part of the annular tube.

U.S. Pat. No. 5,154,007 to Piunno, et al. discloses an apparatus and describes a method for distillation drying of one or more biological samples. The apparatus includes a retaining assembly, a vacuum assembly, a cooling assembly, a monitoring assembly and a control assembly for actively regulating the temperature and pressure conditions of biological tissue so that biological samples may be dried without damage.

U.S. Pat. No. 5,689,895 to Sutherland, et al. discloses a device for positioning a probe (e.g., a temperature sensor) in a flask for freeze-drying. The device includes a stopper secured to an open end of the flask. The stopper has a center opening and at least one radial opening spaced from the center opening. The radial opening allows for fluid communication between inside and outside of the flask when the stopper is secured to the open end of the flask. The center opening receives a guide tube which extends into the flask and receives the probe.

U.S. Pat. No. 6,122,836 to Tenedini, et al. discloses a freeze-drying apparatus and associated lyophilization procedures employing vapor flow detection and/or vacuum control for monitoring and control of a lyophilization process. The vapor flow detector (e.g., a windmill sensor) is disposed to monitor vapor flow from product undergoing lyophilization.

None of the foregoing patents teach a flask, device or container which permits drying (freeze-drying, air-drying, foam drying) of biological materials under sterile conditions and which allows for processing under defined conditions during drying, storage and re-hydration. Therefore, what is needed and what has been invented is a flask and method which overcomes the contamination deficiencies of the prior art. What is more specifically needed and what has been invented is a flask for drying (e.g., freeze-drying) substances under sterile conditions, and method for processing a substance under sterile conditions, including drying, storage, and rehydration. In the method for processing, the flask is placed on a shelf of a freeze-drying and re-hydration apparatus where substances contained in the flask are freeze-dried and re-hydrated without contamination.

SUMMARY OF THE INVENTION

Embodiments of the present invention broadly provide a device for holding substances during drying. The device includes a flask having a structure defining an opening, a first filter member disposed in the opening, and a second filter member disposed in the opening juxtaposedly to the first filter member. The first filter member comprises at least one aperture sized to preclude the passing of bacteria there through. Preferably, first filter member comprises a plurality of apertures having an average opening with an average maximum dimension (e.g. diameter, maximum diagonal distance across opening, etc.) ranging from about 0.10 um to about 0.22 um. In one embodiment of the invention the first filter member has a higher flexibility than the second filter member. In another embodiment of the invention, the difference in average permeability or average maximum dimension of openings (i.e., the openings that permit gases or liquids to pass through) between the first and second filter members ranges from about 0.00 um to about 0.90 um. Thus, if one filter member has an average aperture opening of about 0.22 um, the other filter member may have an average aperture opening ranging from about 0.60 um to about 0.90 um. A retainer ring is engaged to the flask for retaining the first and second filter members in the opening. The structure of the flask additionally comprises a second opening wherein a third filter member maybe disposed. A temperature-conductive member passes through a side of the flask. The device or flask may be disposed in a freeze-drying apparatus where substances contained in the device are processed by freeze-drying and prehydration.

Embodiments of the present invention also provide a method for processing a substance under sterile conditions comprising disposing a substance in a flask, positioning the flask in a drying apparatus, and passing a drying medium through a first filter member and through a second filter member juxtaposed to the first filter member for drying the substance. The method may additionally comprise contacting the substance with a temperature-conductive member for monitoring the temperature of the substance. The temperature-conductive member typically passes through a side of the flask and has a thermocouple coupled thereto. The flask may be exposed to water vapor as desired for prehydration purposes.

These provisions together with the various ancillary provisions and features which will become apparent to those skilled in the art as the following description proceeds, are attained by the methods and flask(s) of the present invention, preferred embodiments thereof being shown with reference to the accompanying drawings, by way of example only, wherein:

DETAILED DESCRIPTION OF PREFERRED EMBODIMENTS OF THE INVENTION

Figure 1:
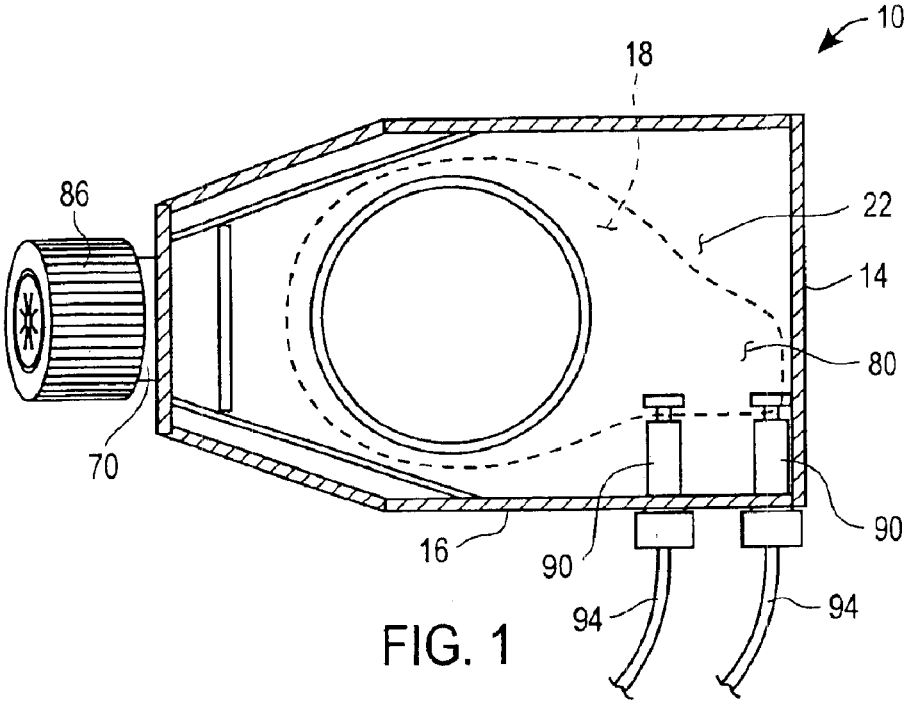
FIG. 1 is a top plan view of the device or flask for holding biological materials.

Referring in detail now to the drawings for various embodiments of the invention, there is seen a flask, generally illustrated as 10, having a bottom 12, a rear wall 14 and side walls 16 and 18 bound to the bottom 12, and a front wall assembly 20 bound to the bottom 12 and the side walls 16 and 18. A top 22 is secured to the rear wall 14, to the side walls 16 and 18, and to the front wall assembly 20. The flask 10 may be manufactured from any suitable material, preferably a transparent plastic (polyethylene, polypropylene, polystyrene, etc.).

Figure 6:
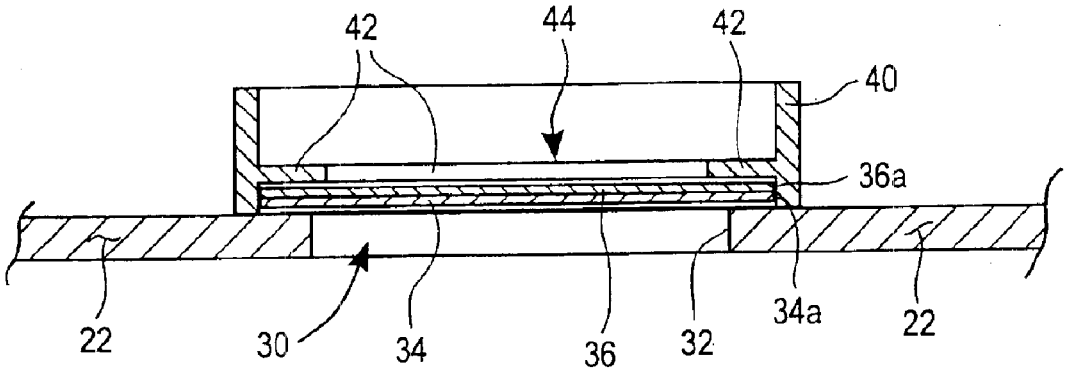
FIG. 6 is an enlarged partial vertical sectional view of the two superimposed filters disposed over the flask opening with the cover or retainer ring coupled to the top of the flask such as to keep the two filters sandwiched over the flask opening.
Figure 7:
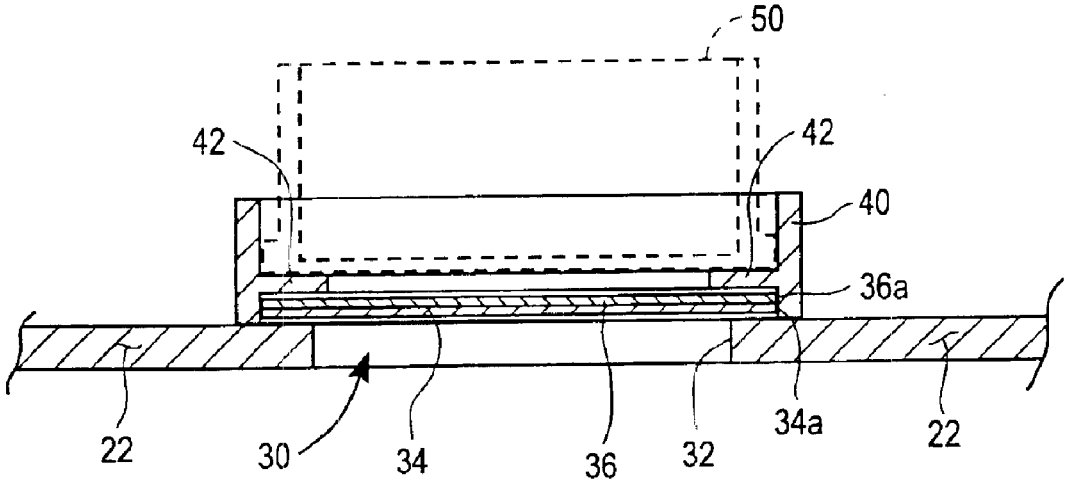
FIG. 7 is the view of FIG. 6 with the filter cover in place and represented by dashed lines.
Figure 8:
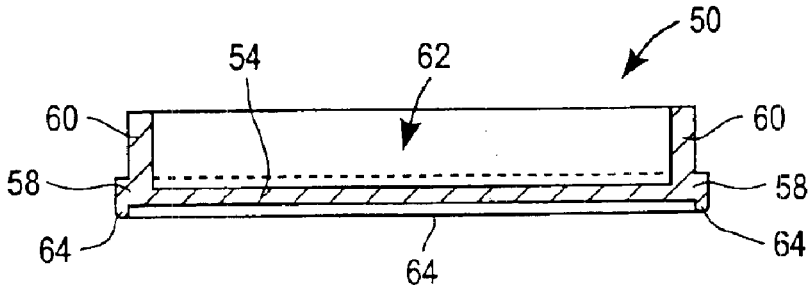
FIG. 8 is a vertical sectional view of the filter cover.

The top 22 of the flask 10 includes an opening 30 with a perimeter 32. Filters 34 and 36 are superimposedly disposed over the opening 30 such that the respective perimeters 34*a* and 36*a* associated with filters 34 and 36 extend beyond the perimeter 32 of opening 30 for structural support purposes, as best shown in FIGS. 6 and 7. A cover or retainer ring 40 is conveniently coupled to the top 22 for holding the filters 34 and 36 in place superimposedly. The retainer ring 40 has in inwardly protruding lip 42 for defining an internal opening 44 to expose filters 34 and 36 and for protruding or lapping over the perimetrical fringes of filters 34 and 36 for posturing same in their filtering position, as best shown in FIGS. 6 and 7. A removable filter cap 50 may be conveniently disposed within the ring 40 to cover internal opening 44 and superimposed filters 34 and 36 (see FIG. 7). As best shown in FIG. 8, filter cap 50 includes a continuous bottom 54 for immediately covering opening 44 and the filters 34 and 36. Bottom 54 terminates in shoulder 58 and an upstanding wall 60 which forms an opening 62 to expose the bottom 54. A depending ridge 64 is integrally secured to shoulder 58 for resting on, and being supported by, protruding lip 42 when the bottom 54 spacedly covers the superimposed filters 34 and 36. The ridge 64 allows the bottom 54 to be spaced or separated from filter 36.

Figure 2A:
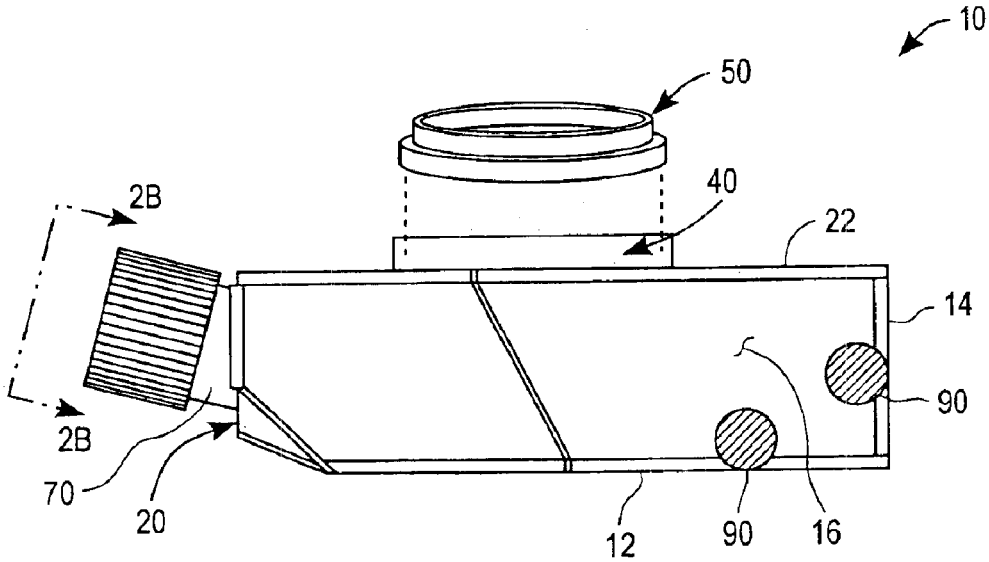
FIG. 2A is a side elevational view of the flask of FIG. 1 illustrating the filter cover and filter cap removed therefrom.
Figure 2B:
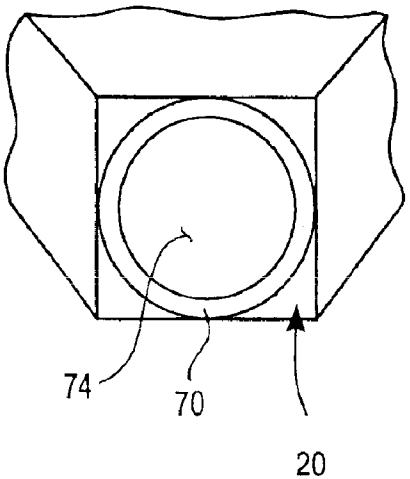
FIG. 2B is a front elevational view of the neck taken in direction of the arrows and along the plane of line 2B—2B in FIG. 2A.
Figure 3:
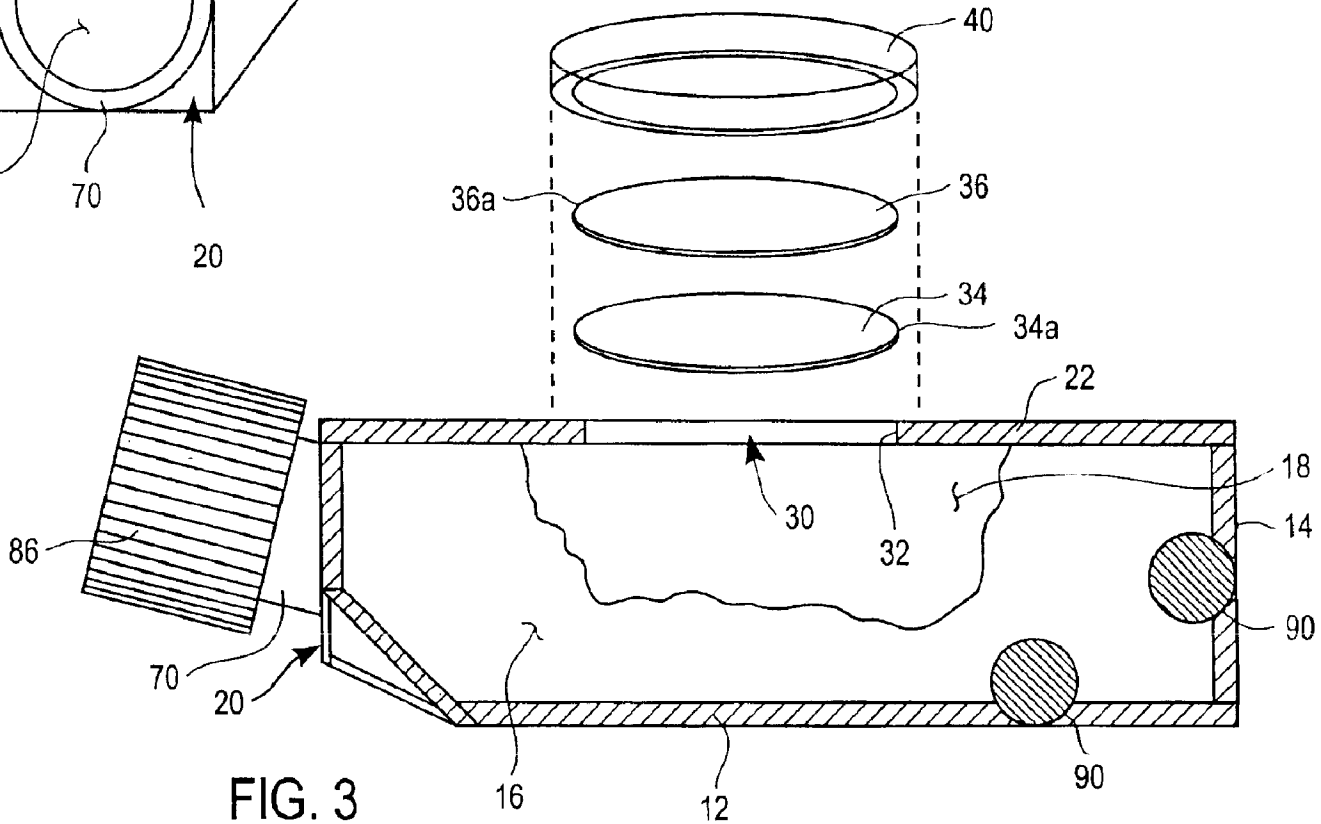
FIG. 3 is an enlarged side elevational partial sectional view of the flask illustrating the top aperture with the filters and covering removed therefrom.
Figure 4:
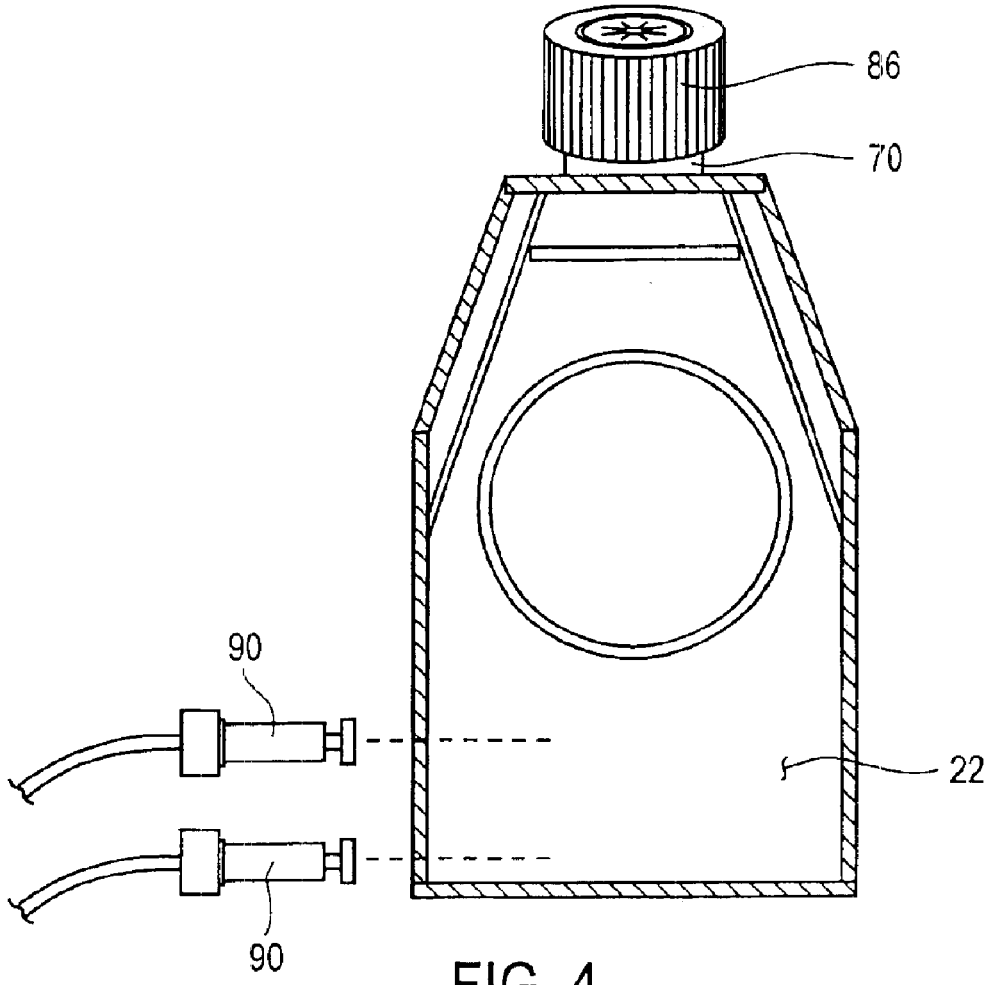
FIG. 4 is a top plan view of the flask illustrating the thermocouple probes which are to pass through a side of the flask and contact any substance therein.
Figure 5:
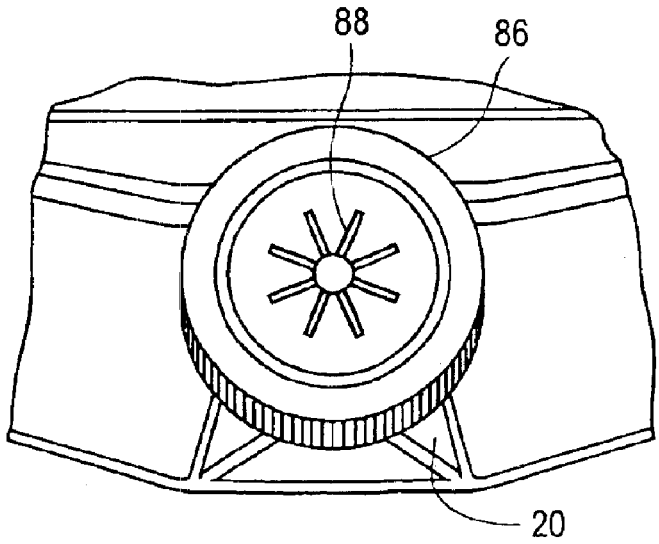
FIG. 5 (PRIOR ART)
FIG. 5 is a front elevational of the removable filter cap having a partially exposed filter.

The front wall assembly 20 is formed with a protruding hollow neck 70 to provide an opening 74 (see FIG. 2B) for placing and removing material 80 inside the flask. Material 80 may be any desired substance to be processed, such as biological materials. Removably secured to neck 70 is a cap 86, preferably a cap 86 including an exposable filter 88 (see hydrophobic filter in FIG. 5) upon suitable rotation or manipulation. The cap 86 may be any suitable cap which is capable of being removably disposed around the neck 70. In one preferred embodiment of the invention, the cap 86 is that manufactured under the trade name "Nunc EasYFlask closure" by Nalge Nunc International Corp. of Naperville, Ill. This particular cap 86 is available as a filter cap (with hydrophobic filter 88) or as a vent/close cap. The Nunc EasYFlask closure system of Nalge Nunc International Corp. allows one to open or close the flask 10 by merely a ⅓ rd turn of the cap 86. Once one removes the cap 86, the opening 74 of the angled neck 70 allows easy access to the entire growth surface of the flask 10 with both pipettes and cell scrapers. The slope and the design of the neck 70 allow complete drainage, and yet minimal risk of any medium within the flask 10 splashing into the opening 74 of the neck 70 when disposing the flask 10 horizontally.

In a preferred embodiment of the invention, one or more temperature probes 90 maybe disposed such as to be in contact with substance or material 80 (see FIG. 1). Preferably, the probes 90 pass through side of side wall 16 and couple to thermocouple conductors 94—94 which extend to an indicator (not shown) for displaying temperature indicia of the substance or material 80. The temperature of the substance or material 80 is preferably monitored during processing, especially the drying process. The progress of the temperature of the material 80 during freeze-drying, air drying, or foam drying provides valuable information about the progress of treatment or processing, especially drying. For this purpose, the temperature probes 90 are placed in contact with the sample or material 80. The thermocouple conductor 94 is coupled to the probe 90 to monitor sample temperature.

Filter 34 is preferably a bacteria-filtering filter which precludes the entry of bacteria into the flask 10. Filter 36 is a prefilter, preferably for filtering large foreign particles, such as dust. Filter 36 is preferably a support membrane type filter which increases the structural rigidity of the combination of the superimposed filters 34 and 36. In operation, filter 34 would typically move or flex toward and/or against filter 36. Preferably, filter 34 has a higher flexibility than filter 36. Preferably further, filter 34 comprises a plurality of apertures having an average opening with an average maximum dimension (e.g. diameter, maximum diagonal distance across the opening, etc.) ranging from about 0.10 um to about 0.65 um, more preferably from about 0.10 um to about 0.45 um, and most preferably from about 0.10 um to about 0.22 um. Filter 36 comprises a plurality of apertures having an average opening with an average maximum dimension (e.g. diameter, maximum diagonal distance across the opening, etc.) ranging from about 0.60 um to about 1.0 um, more preferably from about 0.65 um to about 0.95 um, and most preferably from about 0.70 um to about 0.90 um. Stated alternatively, and in another embodiment of the invention, the difference in average size of filter openings between the filters 34 and 36 ranges from about 0.00 um to about 0.90 um, more preferably from about 0.45 um to about 0.75 um, and most preferably from about 0.50 um to about 0.70 um. Thus, if the average size openings in filter 34 is about 0.22 microns, the average size openings in filter 36 may range anywhere from about 0.60 um to about 0.90 um. Filters 34 and 36 may be manufactured from any suitable material, such as polyvinylidene fluoride, cellulose, fiberglass, etc. Preferably filter 34 is manufactured of polyvinylidene fluoride, while filter 36 is manufactured from fiberglass.

Figure 9:
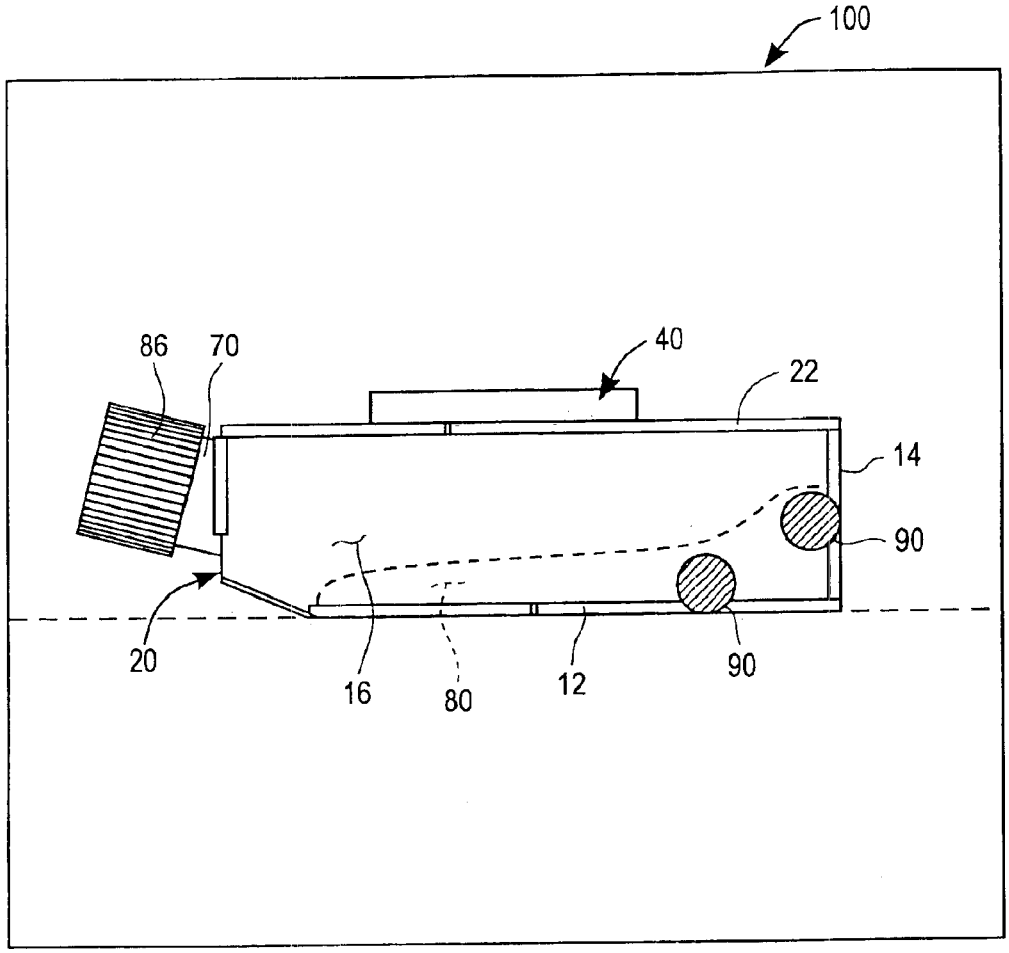
FIG. 9 is a partial perspective view of a freeze-drying apparatus containing the flask for treating or processing any biological materials contained in the flask.

In a method for processing a substance or the material 80 under sterile conditions, the material 80 is disposed in the flask 10 via the opening 74 in the neck 70. The flask 10 containing the material 80 is then placed in a suitable apparatus for processing the material 80 with the flask 10. The apparatus for processing, generally illustrated as 100 in FIG. 9, may be any suitable apparatus for drying and/or rehydrating the material 80. A suitable apparatus 100 is that which is manufactured by Kinetics Group, Inc., and sold under the trade name FTS Systems Lyostar.

After the flask 10 containing the material 80 has been suitably disposed in apparatus 100, the material 80 is frozen within the flask 10 at a rate that is considered optimal for the sample and as can be controlled by an apparatus, such as apparatus 100. Once frozen to low temperature, such as −60° C. for example, the sample can be exposed to a strong vacuum as produced by the drying apparatus 100. The applied vacuum draws water out of the samples by sublimation of the frozen water, making the ice change directly into liquid vapor. The water vapor leaves the material 80 and passes serially through the filters 34 and 36 and is collected within the apparatus 100 by a condenser. This drying continues as the material 80 is slowly heated back to ambient room temperature under vacuum.

After freeze-drying, the flask 10 containing the freeze-dried sample may be removed from the apparatus 100 and for storage purposes. Storing in a sterile manner may be at room temperature in a suitable dry location while the freeze-dried material 80 remains in the flask. During storage, the filter cap 50 may be placed within the confines of the ring 40 to cover internal opening 44 of the retainer ring 40 and the superimposed filters 34 and 36. When it is desired to use material 80, the flask 10 including the material 80 is removed from storage and is subsequently disposed within a suitable humid chamber for rehydration of the freeze-dried material 80. During rehydration, minute particulates of water vapor pass through filters 36 and 34 while contamination is prevented from entering the inside of flask 10 by the filters 34 and 36. The water vapor is typically at a temperature ranging from about 20° C. to about 37° C. The remaining rehydration is then achieved by the addition of water, and/or a preferred resuspension solution, such as a cell growth medium, via the opening 74 in neck 70 of the flask 10.

Embodiments of the present invention will be illustrated by the following set forth example which is being given to set forth the presently known best mode and by way of illustration only and not by way of any limitation. All parameters such as concentrations, mixing proportions, temperatures, rates, compounds, etc., submitted in these examples are not to be construed to unduly limit the scope of the invention.

EXAMPLE

The flask 10 may be loaded with a sterile sample, in a sterile hood, sealed, and then transferred to the drying apparatus (a freeze-dryer) 100, such as that manufactured by Kinetics Group, Inc. The sterile sample may be 293H human embryonic kidney cell line in 2.5 ml buffer solution. When freeze-drying is complete, the flask 10 containing the freeze-dried sample may be stored without precautions against contamination since the flask 10 is a closed system. Vapor phase re-hydration may be accomplished simply by exposing the flask 10 to water vapor within a humidified incubator. Since the water vapor contacts the sample by passage through the bacterial filter 34, there is no risk of contamination. It is preferable to monitor sample temperature during the drying process. The progress of sample temperature during freeze drying, air drying, or foam drying provides valuable information about the progress of drying. For this purpose, the end of the temperature probe 90 may be placed in contact with the sample or material 80. The thermocouple wire 94 is coupled to temperature probes 90.

Figure 10:
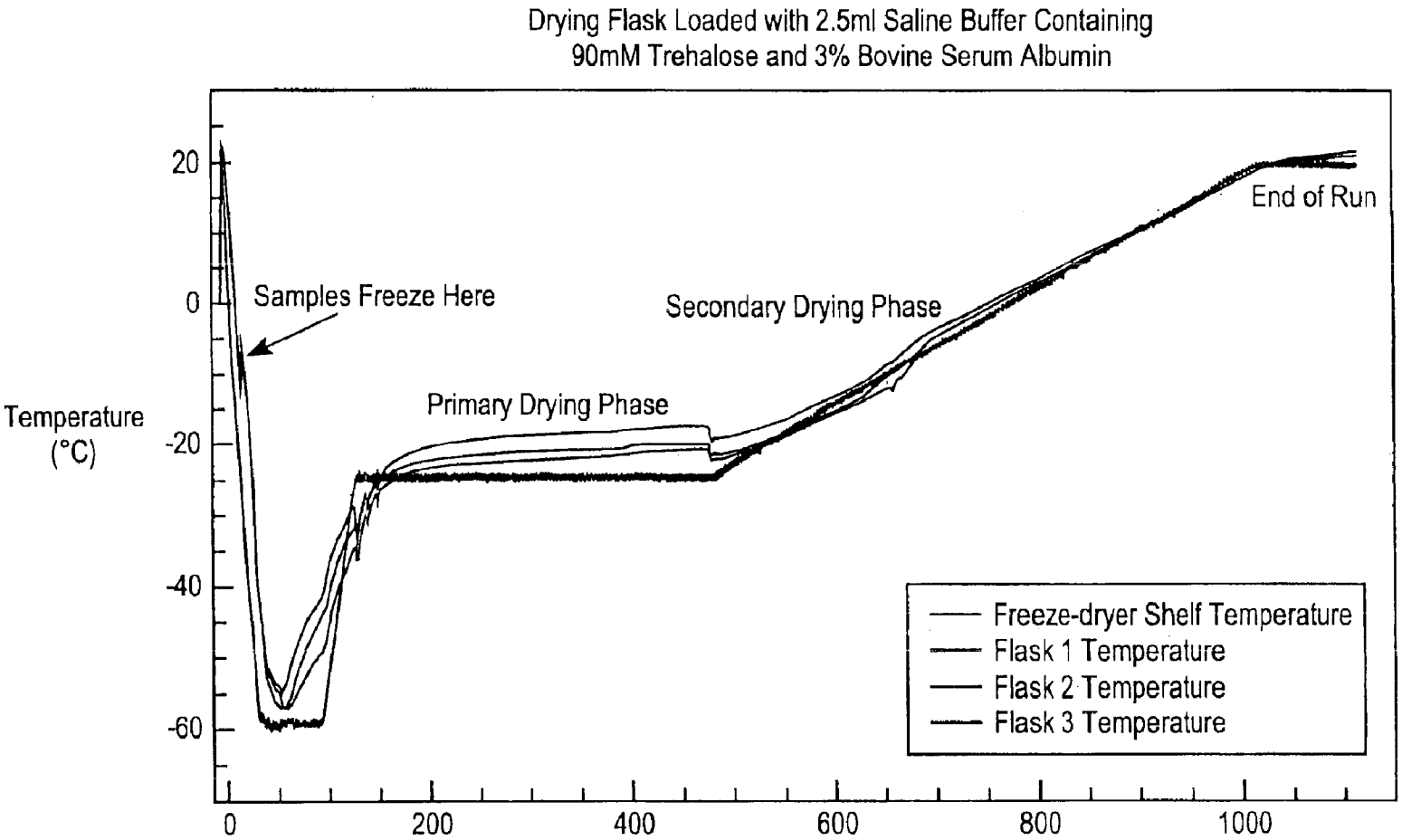
FIG. 10 is a graph of freeze-drying sample temperatures during three simultaneous freeze-drying runs.
Figure 11:
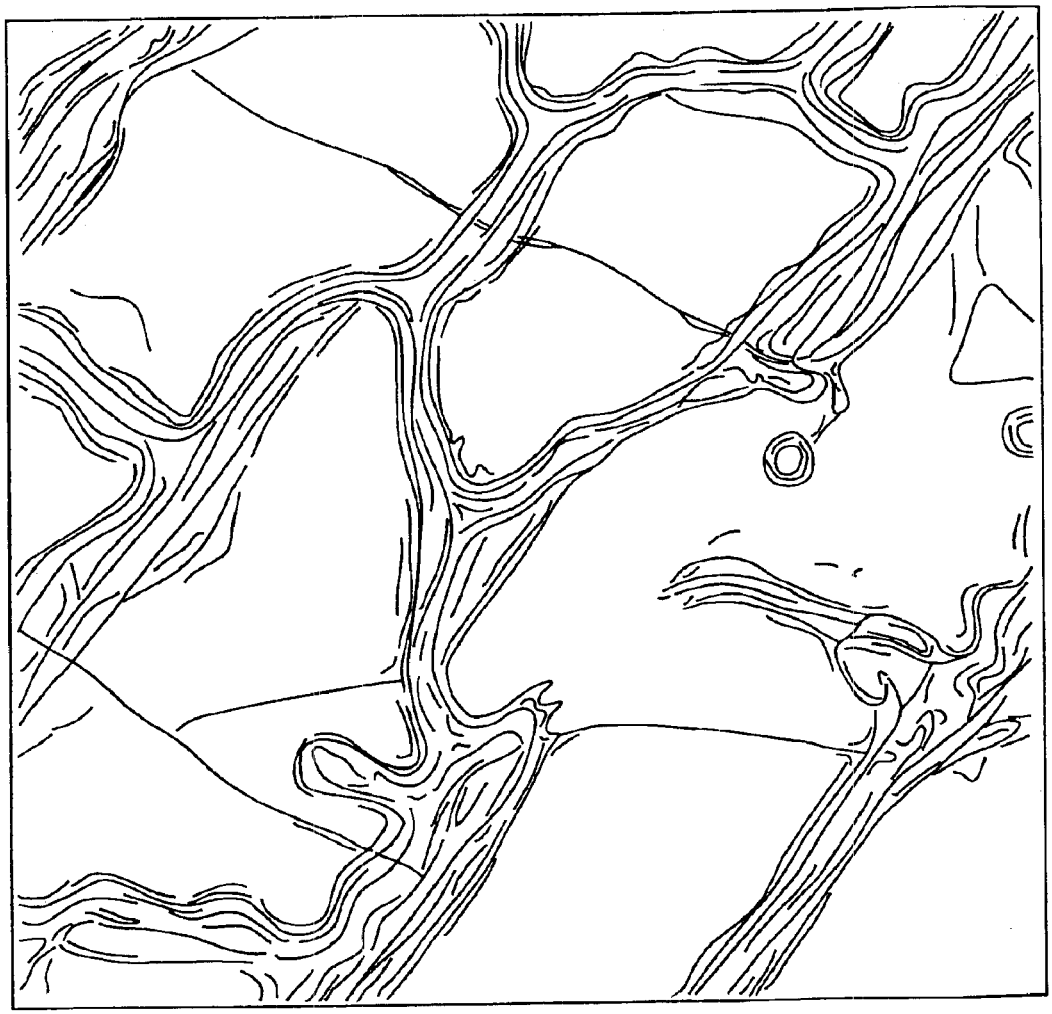
FIG. 11 is an image of dried cells for the Example taken on film using an inverted microscope, showing the dried cells encased within strands of the drying matrix.

Material 80 used in the example consisted of a 2.5 ml sample buffer solution containing 293H cells placed within flasks 10 via the opening 74 in neck 70. The flasks 10 were placed within the apparatus 100 for freeze-drying. The flasks 10 and samples 80 were frozen at 1° C. per minute to −60° C. and held at that temperature for 1 hour. The vacuum was initiated during this time interval while the samples were held at −60° C. As the vacuum was applied by apparatus 100, the change in sample temperature was observed via port 90 due to the heat released by the material 80 during loss of water, as indicated by FIG. 10. Next, under vacuum, the samples were held at −25° C. for an additional 6 hours. Following this time interval, the samples were subsequently slowly heated back to room temperature of +22° C. over an 8 hour period while still under vacuum. FIG. 10 depicts the process in its entirety and displays flask temperatures as monitored through temperature port 90 of each flask and shelf temperatures, both as monitored by apparatus 100. FIG. 10 more specifically shows sample temperatures during three simultaneous freeze-drying runs, illustrating repeatable processing. All came to minimal water contents simultaneously. Residual water content was≦3% by weight. Maintenance of sterility was assessed during processing. Thus, starting with sterile sample materials 80, the flasks 10 were subjected to freeze-drying, followed by re-hydration in culture media, in a sterile hood. Over the following nine days sterility was assessed by microscopy and pH change. Based on these criteria, no contamination was evident. FIG. 11 is an image of the dried cells for this Example. The FIG. 11 image was taken on film using an inverted microscope and shows the dried cells encased within strands of the drying matrix.

Therefore, due to the inherent design, having a set of filters 34 and 36 covering a smaller area than the top surface 22 of the flask and having a flask 10 that is of rigid, transparent plastic, one can view a sample 80 disposed within the flask 10 (prior to or after drying) directly using a 1*b* microscope (preferably an inverted type or by inversion of the flask 10 on a standard scope) without any risk of contamination to a sterile sample 80. In other words, by having the filers 34 and 36 only covering a portion of the upper surface 22, there is a free visual path through the plane of the bottom surface 12 (via top surface 22) of the flask 10 for allowing microscopic (visible, fluorescence, etc.) viewing. With a microscopy, valuable photographs (micrographs, digital images, video, etc.) can be taken of the samples 80 during any stage of the process. These images can help one ascertain the quality of drying, the integrity of a sample, sample structure, and allow viability assays, while the samples 80 are still contained within the flask 10.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope and spirit of the invention as set forth. Therefore, many modifications may be made to adapt a particular situation or material to the teachings of the invention without departing from the essential scope and spirit of the present invention. It is intended that the invention not be limited to the particular embodiment disclosed as the best mode contemplated for carrying out this invention, but that the invention will include all embodiments and equivalents falling within the scope of the appended claims.

What is claimed is:

1. A device for holding substances during drying comprising a flask having a structure defining a first opening; a first filter member disposed in the first opening; a second filter member disposed in the first opening juxtaposedly to the first filter member, a second opening, and a third filter member disposed in said second opening.

2. A device for holding substances during drying comprising a flask having a structure defining a first opening; a first filter member disposed in the first opening; a second filter member disposed in the first opening juxtaposedly to the first filter member, and a temperature-conductive member passing through a side of the flask.

3. A freeze-drying assembly comprising a freeze-drying apparatus; and a device disposed in said apparatus for holding substances during freeze-drying, said device comprising a flask having a structure defining an opening, a first filter member disposed in the opening, and a second filter member disposed in the opening juxtaposedly to the first filter member.

4. The freeze-drying assembly of claim 3 wherein said first filter member has a higher flexibility than the second filter member.

5. The freeze-drying assembly of claim 3 wherein said structure of said flask additionally comprises a second opening.

6. The freeze-drying assembly of claim 5 additionally comprising a third filter member disposed in said second opening.

7. The freeze-drying assembly of claim 6 additionally comprising a temperature-conductive member passing through a side of the flask.

8. The freeze-drying assembly of claim 3 additionally comprising a temperature-conductive member passing through a side of the flask.

9. The freeze-drying assembly of claim 3 wherein said first filter member includes a flexed structure in contact with the second filter member.

10. The freeze-drying assembly of claim 3 wherein said first filter member and said second filter member have no absorbing material disposed between them.

11. A method for processing a substance under sterile conditions comprising disposing a substance in a flask; positioning the flask in a drying apparatus; and passing a drying medium through a first filter member and through a second filter member juxtaposed to the first filter member for drying the substance.

12. The method of claim 11 additionally comprising re-hydrating the dried substance.

13. The method of claim 11 additionally comprising moving the second filter member against the first filter member.

14. The method of claim 11 additionally comprising contacting the substance with a temperature-conductive member for monitoring the temperature of the substance.

15. The method of claim 14 additionally comprising coupling a thermocouple to the temperature-conductive member.

16. The method of claim 13 wherein said moving of the second filter member comprises flexing the second filter.

17. The method of claim 11 additionally comprising exposing the flask to water vapor.

18. The method of claim 11 wherein said flask comprises a transparent structure.

19. The method of claim 18 additionally comprising viewing the substance through the transparent structure.

20. A device for holding substances during drying comprising a flask having a structure defining a first opening; a first filter member disposed in the first opening; a second filter member disposed in the first opening and having the capability of being contacted by the first filter when the first filter is flexed, a second opening, and a third filter member disposed in a second opening.

21. A device for holding substances during drying comprising a flask having a structure defining an opening; a first filter member disposed in the opening; a second filter member disposed in the opening and having the capability of being contacted by the first filter when the first filter is flexed, and a temperature-conductive member passing through a side of the flask.

22. A device for holding substances during drying comprising a flask having a structure defining an opening; a first filter member disposed in the opening; a second filter member disposed in the opening and having the capability of being contacted by the first filter when the first filter is flexed, and a pair of temperature-conductive members passing through the flask.

23. A device for holding substances during drying comprising a flask having a structure defining an opening; a first filter member disposed in the opening; a second filter member disposed in the opening and having the capability of being contacted by the first filter when the first filter is flexed, a retainer ring engaged to the flask for retaining the first and second filter members in the opening wherein said retainer ring includes an inwardly protruding lip extending over a portion of the second filter member disposed between the inwardly protruding lip and the flask and, a cap coupled to the retainer ring.

24. A device for holding substances during drying comprising a flask having a structure defining an opening; a first filter member disposed in the opening; a second filter member disposed in the opening and having no absorbing material positioned between the first and second filter members, and at least one temperature-conductive member passing through the flask.

25. A device for holding substances during drying comprising a flask having a structure defining an opening; a first filter member disposed in the opening; a second filter member disposed in the opening wherein said first and second filter members are juxtaposed with respect to each other and have no absorbing material positioned between the first and second filter members, and at least one temperature-conductive member passing through the flask.

26. A method for processing a substance under sterile conditions comprising disposing a substance in a flask; positioning the flask in a drying apparatus; passing a drying medium through a first filter member and through a second filter member for drying the substance; and moving the second filter towards the first filter member.

27. The method of claim 26 additionally comprising re-hydrating the dried substance.

28. The method of claim 26 additionally comprising moving the second filter member against the first filter member.

29. The method of claim 26 wherein said second filter member is juxtaposed to the first filter member.

30. The method of claim 26 wherein said first filter member and said second filter member have no absorbing material disposed between them.

31. A method for processing a substance under sterile conditions comprising disposing a substance in a flask; positioning the flask in a drying apparatus; and passing a drying medium through a first filter member and through a second filter member juxtaposed to the first filter member for drying the substance wherein said first filter member and said second filter member have no absorbing material disposed between them.

32. A device for holding substances during drying comprising a flask having a structure defining an opening; a first filter member disposed in the opening; a second filter member disposed in the opening; and a temperature-conductive member passing through a side of the flask.

33. The device of claim 32 wherein said structure defines a second opening.

34. The device of claim 33 additionally comprising a third filter member disposed in said second opening.

35. The device of claim 32 wherein said second filter possesses the capability of being contacted by the first filter when the first filter is flexed.

36. The device of claim 34 wherein said second filter possesses the capability of being contacted by the first filter when the first filter is flexed.

* * * * *